US005769800A

United States Patent [19]

Gelfand et al.

[11] Patent Number: 5,769,800

[45] Date of Patent: Jun. 23, 1998

[54] VEST DESIGN FOR A CARDIOPULMONARY RESUSCITATION SYSTEM

[75] Inventors: Mark Gelfand, Baltimore, Md.; Kreg George Gruben, Stoughton, Wis.; Henry Halperin, Baltimore, Md.; Jeff Koepsell, Alpharetta, Ga.; Neil Rothman, Baltimore; Joshua E. Tsitlik, Reisterstown, both of Md.

[73] Assignees: The Johns Hopkins University Inc.; Cardiologic Systems, both of Baltimore, Md.

[21] Appl. No.: 404,442

[22] Filed: Mar. 15, 1995

[51] Int. Cl.[6] ..... A61H 31/00

[52] U.S. Cl. ..... 601/151; 601/41; 601/44; 601/152

[58] Field of Search ..... 601/41, 43, 44, 601/150, 151, 106, 148, 149, 152, 153

[56] References Cited

U.S. PATENT DOCUMENTS

| | | | |
|---|---|---|---|
| 2,869,537 | 1/1959 | Jen-Chu Chu . | |
| 3,167,067 | 1/1965 | Rand . | |
| 3,566,862 | 3/1971 | Schuh | 601/44 |
| 4,077,400 | 3/1978 | Harrigan . | |
| 4,349,015 | 9/1982 | Alferness . | |
| 4,424,805 | 1/1984 | Newman et al. . | |
| 4,520,820 | 6/1985 | Kitchin et al. . | |
| 4,664,095 | 5/1987 | Woudenberg et al. . | |
| 4,770,164 | 9/1988 | Lach et al. . | |
| 4,881,827 | 11/1989 | Lerman . | |
| 4,928,674 | 5/1990 | Halperin et al. . | |
| 5,000,164 | 3/1991 | Cooper . | |
| 5,056,505 | 10/1991 | Warwick et al. . | |
| 5,222,478 | 6/1993 | Scarberry et al. . | |
| 5,307,791 | 5/1994 | Senoue et al. . | |
| 5,361,418 | 11/1994 | Luzenske | 128/874 |
| 5,370,603 | 12/1994 | Newman . | |

OTHER PUBLICATIONS

"Mechanical CPR is Said to Improve Blood Flow", *New York Times* article, Sept. 1988.

"Emergency Medical Technology", SurTech, HLR Heart–Lung Resuscitator Performs the ABC'S of Cardio–Pulmonary Resuscitation (CPR).

"Augmentation of Carotid Flow During Cardiopulmonary Resuscitation by Ventilation at High Airway Pressure Simultaneous With Chest Compression," N. Chandra, M.D. et al, *The American Journal of Cardiology,* vol. 48, Dec. 1981, pp. 1053–1063.

"Regional Blood Flow During Cardiopulmonary Resuscitation in Dogs Using Simultaneous and Nonsimultaneous Compression and Ventilation," J. Luce, M.D. et al, Dept. of Medicine . . . Univ. of Washington School of Medicine, Seattle, Washington, Circulation 67, No. 2, 1983, pp. 258–265.

"Mechanical 'Cough' Cardiopulmonary Resuscitation During Cardiac Arrest in Dogs," J. Niemann, M.D. et al, Dept. of Emergency Medicine, . . . UCLA School of medicine, Torrence, California, etc. pp. 199–204.

AFCR Cardiovascular, p.161A.

(List continued on next page.)

*Primary Examiner*—Robert A. Hafer
*Assistant Examiner*—Benjamin K. Koo
*Attorney, Agent, or Firm*—Nixon & Vanderhye

[57] ABSTRACT

An improved vest design for cardiopulmonary resuscitation is disclosed. The vest includes an inflatable bladder capable of radial expansion to first conform to a patient's chest dimensions and then to apply circumferential pressure. The improved vest design affords ease of placement on a patient without concern for how tightly the vest is initially applied. Also disclosed are various vest designs that reduce the amount of compressed air that must be used for each compression/decompression cycle of the vest. These improvements lower the energy consumption and make smaller and portable cardiopulmonary resuscitation systems possible.

6 Claims, 9 Drawing Sheets

OTHER PUBLICATIONS

"Augmentation of Cardiac Function by Elevation of Intrathoracic Pressure," M. Pinsky et al, American Physiological Society, pp. 950–955.

"Hemodynamic Effects of Cardiac Cycle–Specific Increases in Intrathoracic Pressure," M. Pinsky et al, American Physiological Society, pp. 604–612.

"Programmable Pneumatic Generator for Manipulation of Intrathoracic Pressure," H. Halperin, M.D. et al, IEEE Transactions of Biomedical Engineering, vol. BME–34, No. 9, Sept. 1987, pp. 738–742.

"Vest Inflation Without Simultaneous Ventilation During Cardiac Arrest in Dogs: Improved Survival from Prolonged Cardiopulmonary Resuscitation," H. Halperin, M.D. et al, Dept. of Medicine, The Johns Hopkins Medical Institutions, Baltimore, vol. 74, No. 6, Dec. 1986, pp. 1407–1415.

"Intrathoracic and Abdominal Pressure Variations as an Efficient Method for Cardiopulmonary Resuscitation: Studies in Dogs Compared With Computer Model Results," R. Beyar et al,. Cardiovascular Research, 1985, 19, 335–342.

VEST DESIGN FOR A CARDIOPULMONARY RESUSCITATION SYSTEM

BACKGROUND OF THE INVENTION

1. Field of the Invention

The present invention relates to cardiopulmonary resuscitation (CPR) and circulatory assist systems and in particular to an improved vest design providing both ease of application and reduced energy consumption.

2. Description of the Prior Art

Cardiac arrest is generally due to ventricular fibrillation, which causes the heart to stop pumping blood. The treatment of ventricular fibrillation is defibrillation. If, however, more than a few minutes have lapsed since the onset of ventricular fibrillation, the heart will be sufficiently deprived of oxygen and nutrients such that defibrillation will generally be unsuccessful. At that point it is necessary to restore flow of oxygenated blood to the heart muscle by cardiopulmonary resuscitation in order for defibrillation to be successful.

U.S. Pat. No. 4,928,674 issued to Halperin et.al. teaches a method of cardiopulmonary resuscitation that generates high levels of intrathoracic pressure. Halperin et.al. teaches the use of an inflatable vest operating under a pneumatic control system to apply circumferential pressure around a patient's chest. Halperin et.al. discloses various vest designs using a rigid base and one or more inflatable bladders. The present invention represents an improvement to the vest design taught by Halperin et.al. to achieve two results: first, to design a vest which can be easily applied to a patient without concern for how tightly the vest is applied; and, second, to design a vest which requires less compressed air to achieve the same compression/depression cycle and therefore consumes less energy. The latter result would make a portable CPR system practical.

Other prior art vest designs suggest for CPR use, which do not achieve the above results, are found in U.S. Pat. 4,424,806 and 4,397,306. Similarly, other pneumatic vest designs are known in the art search as the pneumatic pressure respiratory vest described in U.S. Pat. 2,869,537. However, such vests are not designed for cardiopulmonary resuscitation systems and therefore were not designed to achieve ease of application during an emergency situation or minimize energy consumption.

SUMMARY OF THE INVENTION

The present invention is an improved inflatable vest designed to be used in cardiopulmonary resuscitation (CPR) and circulatory assist systems. The vest overcomes deficiencies in prior art designs and specifically accomplishes two objectives. The first objective is to achieve a vest design which can easily be applied in an emergency situation. Key to the achievement of this objective is the design of a radially expandable bladder which first expands to conform to a patient's dimensions and then applies the desired circumferential pressure. The second objective is a vest design which minimizes the amount of compressed air needed in the compression/decompression cycle. Achieving this objective reduces energy consumption and makes a portable vest system practical.

In order to achieve the first objective the invented vest is designed to work equally well whether it is applied tightly or loosely. It is designed to easily slip under a patient laying on his back and extend around the patient's chest. It is designed to attach easily around the patient's chest without the need for complicated hooks or locks. The improved vest is also designed with a safety valve positioned directly on the vest. Key to the improved vest design is a bladder means for radially expanding when filled with compressed air to conform to the patient's dimensions regardless of how tightly or loosely the vest is applied.

In order to achieve the second objective, the "dead space" in the pneumatic hose and vest is reduced. "Dead space" is defined as that volume of bladder and tubing not contributing to chest compression. Several embodiments of the vest design are disclosed to accomplish this objective. In a first embodiment, inflation and deflation poppet valves are incorporated into the design of a multilumen pneumatic hose supplying compressed air to the vest. In a second embodiment uniquely designed inflation/deflation poppet valves are incorporated into the vest. In a third embodiment various techniques are taught to further eliminate the "dead space" occurring in the vest.

DETAILED DESCRIPTION OF THE PREFERRED EMBODIMENTS

Figure 1A:
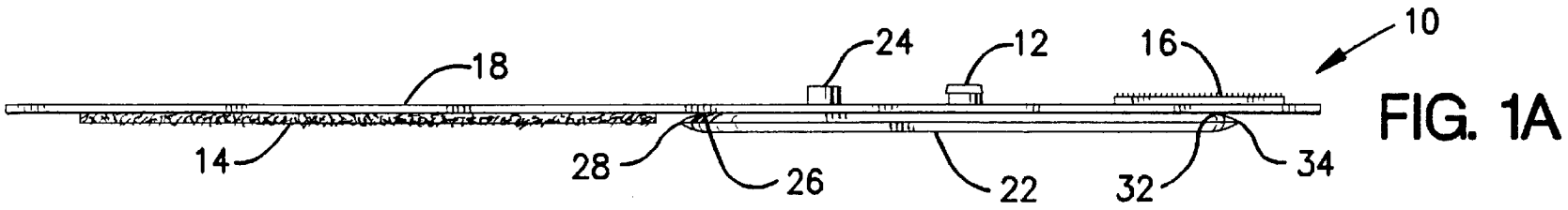
FIGS. 1*a*–1*c* are engineering drawings showing various views of the improved CPR vest design.
Figure 1B:
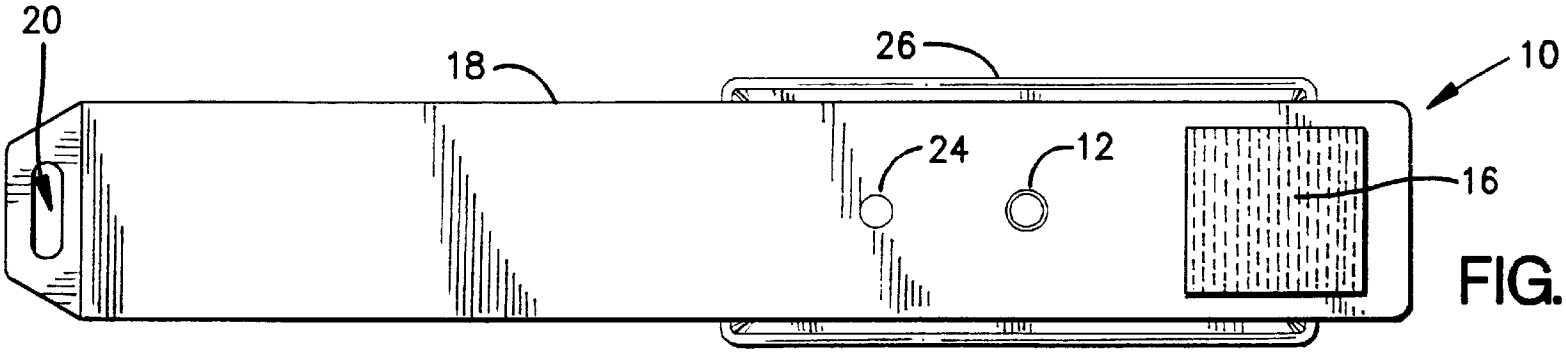
Figure 1C:
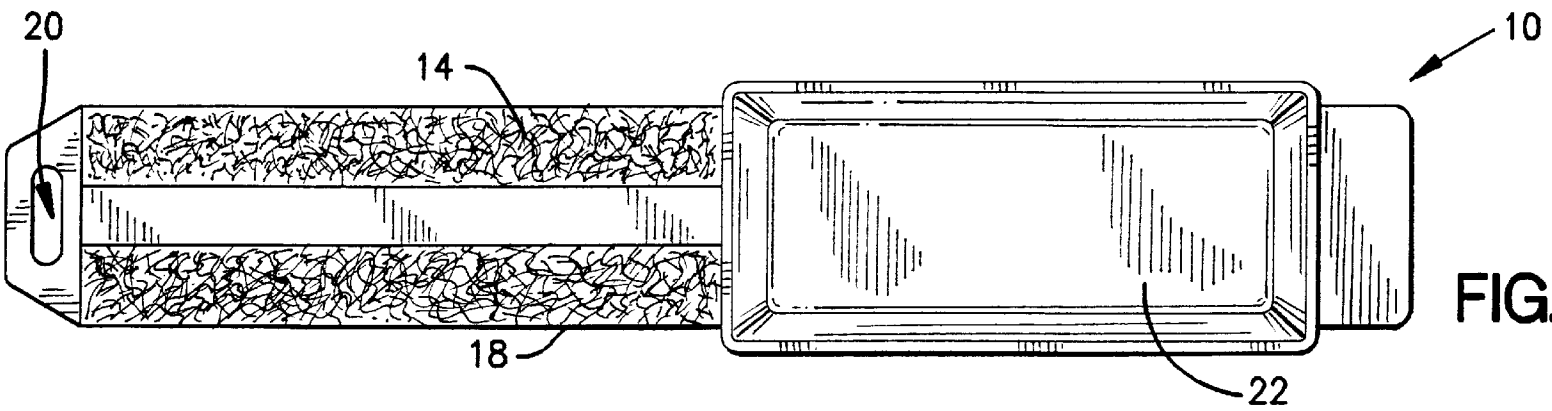

The details of the improved vest design 10, as taught by the present invention, are shown in FIGS. 1A, 1B, and 1C. The vest 10 is coupled by connector 12 to a hose and a pneumatic control system (shown in FIG. 3) for controlled inflation and deflation. The vest 10 is designed to fit around a patient's chest with velcro strips 14 and 16 used to secure the vest around the patient. The body of the vest 10 comprises a belt 18, a handle 20, a radially expandable bladder 22, and pressure safety valve 24. The belt 18 can be made from polyester double coated with polyurethane. The integral safety valve 24 provides additional protection against over inflation of the vest. The handle 20 is used to assist the operator in applying the vest 10 around the patient. In operation, the patient who would be normally on his back would be rotated to his side. In one technique for applying the vest, the vest handle 20 would be pushed under the patient and the patient rotated back onto his back. The handle 20 would than be used for pulling the vest from under the patient a short distance. The portion of the vest remaining on the patient's other side would be wrapped around the chest, with the velcro strip 16 positioned to engage the velcro strip 14 adjacent to the handle 20. With the vest now secured around the patient's chest, the bladder 22 can be inflated in a controlled manner to apply circumferential compression to the chest. The controlled inflation and deflation of the vest, with the resulting circumferential compression of the chest drives oxygenated blood to the heart and brain.

Figure 2A:
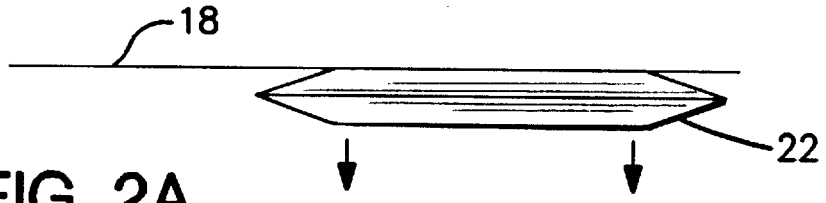
FIGS. 2*a*–2*c* are schematic drawings showing the radial expansion of the bladder means in order to compensate for the initial tightness of the vest.
Figure 2B:
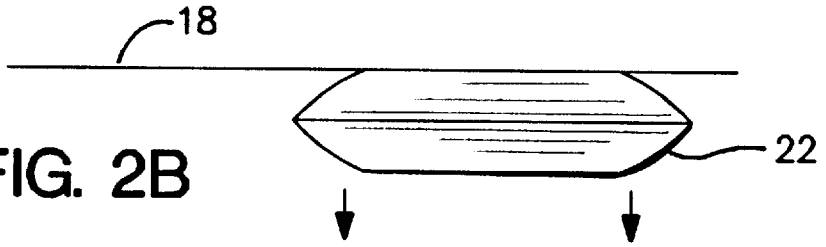
Figure 2C:
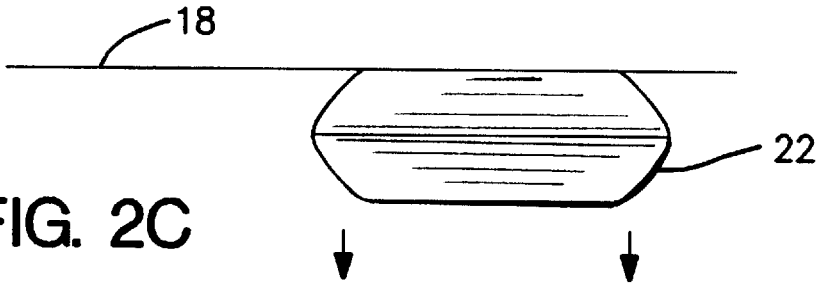

The improved vest design is insensitive to how tightly the vest is applied to the patient. The vest is self compensating for different patient dimensions. The bladder 22 is designed to be radially expandable and thus to apply a preset pressure to the patient's chest regardless of how tightly the vest is initially applied. Bladder 22, as shown in FIGS. 1A, 1B, and 1C is made from two flat pieces of a nylon fabric double coated with polyurethane, and connected along seams 26, 28, and 32, 34. This design geometry, and similar designs using multiple side panels, allows the bladder to extend radially (like a bellows) when inflated. Radial expansion is achieved by using an inextensible material, that has no significant ballooning when inflated, and a geometry that permits extension in one direction. This radial expansion is best shown in FIGS. 2*a*, 2*b*, and 2*c*. When the bladder is inflated it expands radially to make contact with the patient's chest. Whether the belt 18 is attached loosely or tightly around the patient's chest, the bladder is designed to radially expanded to evenly contact the chest. After contacting the chest, the bladder can be further pressurized to apply consistent circumferential compression to the chest. This feature of the vest design is key to the practical application of the CPR vest around a patient.

Figure 3:
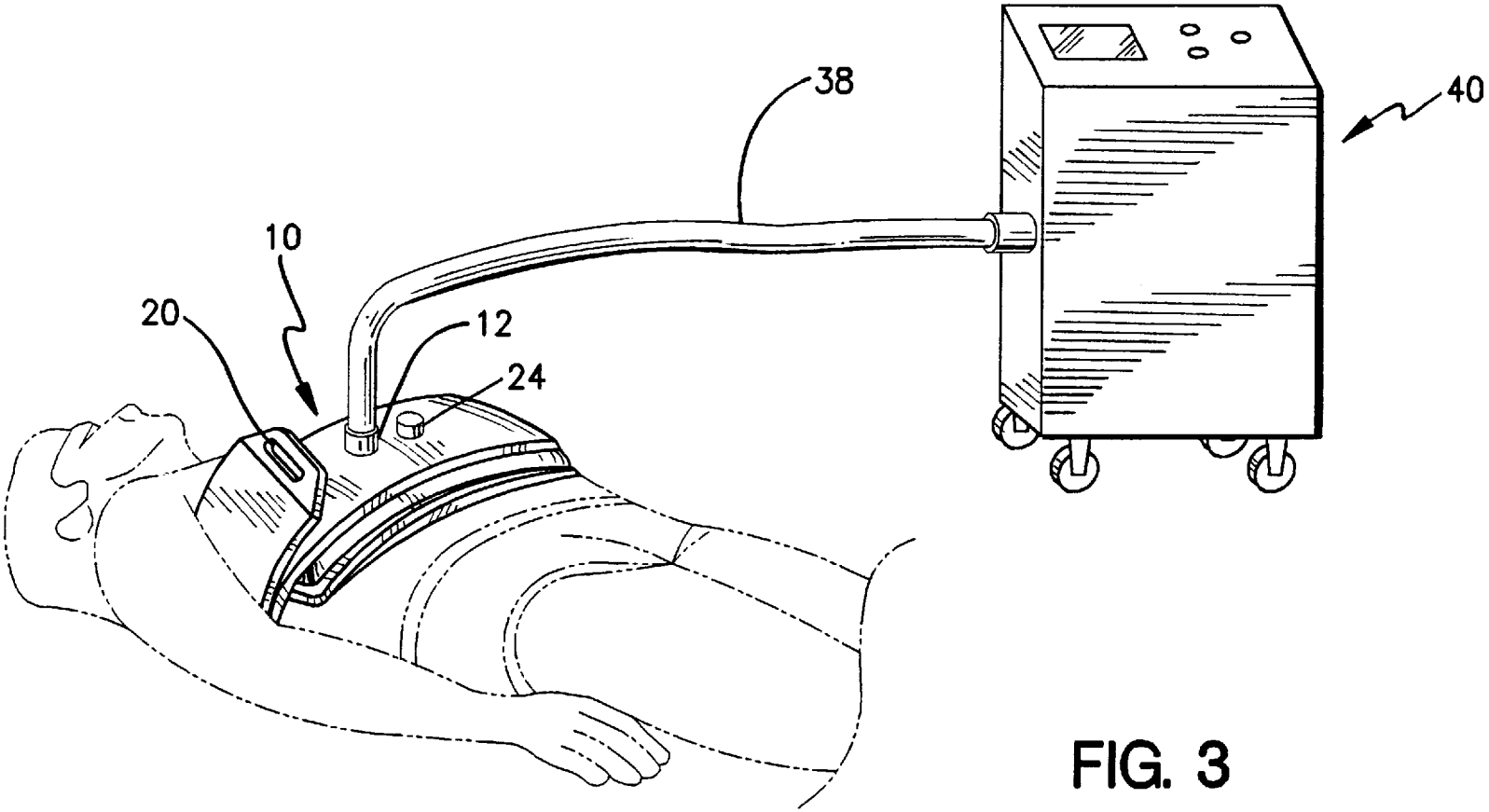
FIG. 3 is a schematic drawing of the CPR system, including the improved vest design.

FIG. 3 is a schematic diagram showing the improved vest 10 as part of the overall cardiopulmonary resuscitation system. Female connector 12 on the vest 10 connects it by a hose 38 to the pneumatic control system 40. The vest 10 is placed around the patient using handle 20 to pull the vest under the patient's back. The vest is then secured to the patient by connecting velcro strips 14 and 16 (as shown in FIG. 1A). Because of the unique vest bladder design, the vest need not be attached around the patient with any specified firmness. The bladder design allows it to compensate for a loose or tight vest fit.

Figure 4:
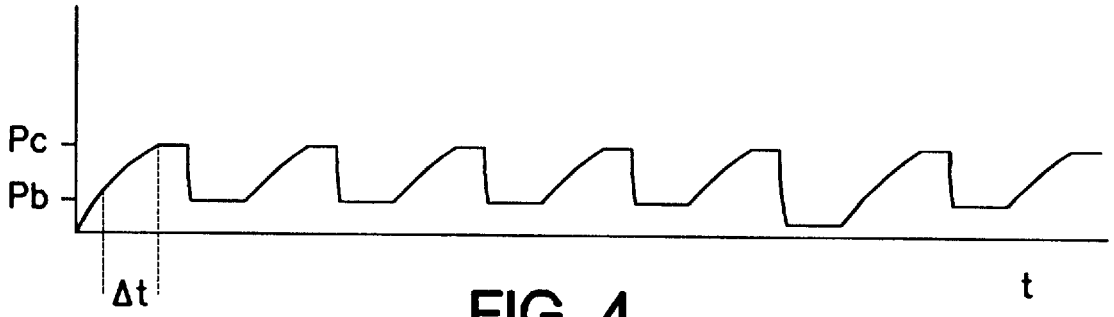
FIG. 4 shows the pressure curve in the CPR vest during its inflation/deflation cycles.

The pneumatic control system 40 inflates and deflates the bladder 22 to achieve a particular cycle of chest compression and release. As shown in FIG. 4, the bladder is first inflated to apply a certain circumferential pressure to the chest (Pc); the bladder is then deflated in a controlled manner to a second lower bias pressure (Pb). This cycle is repeated a number of times; at a set number of cycles the bladder pressure is decreased further to ambient pressure (Pa) to allow ventilation of the patient. This overall cycle is repeated as long as the treatment is applied. In the embodiment illustrated in FIG. 4, the bladder pressure is decreased to ambient pressure (Pa) on the fifth cycle.

Figure 5:
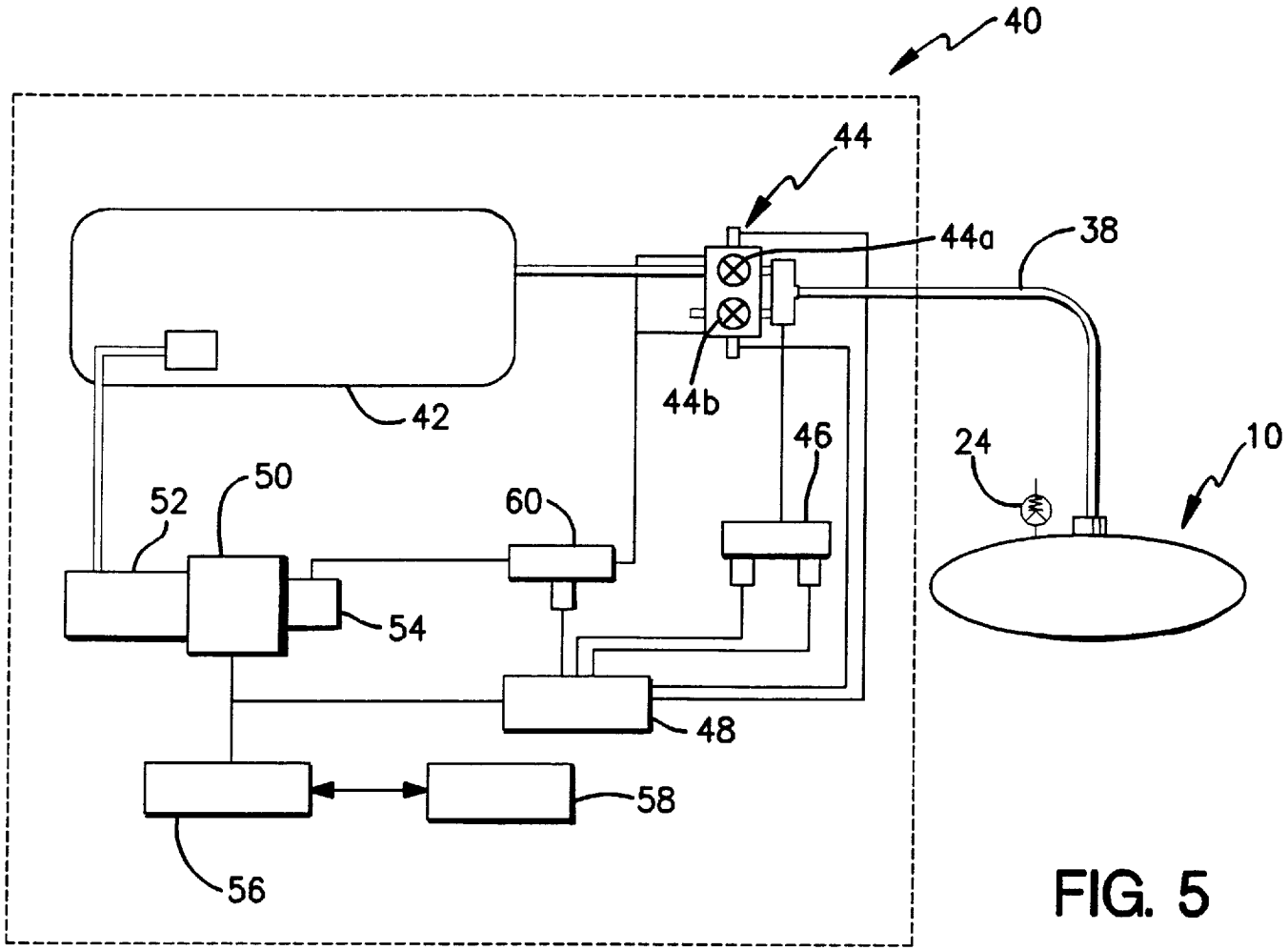
FIG. 5 is a schematic drawing showing the pneumatic control system for use with the vest.

FIG. 5 is a schematic drawing showing the control system 40, connected by pneumatic hose 38 to the invented vest 10. The emergency relief valve 24 is incorporated into the vest design and would release air from the vest if pressure exceeds some set amount above the designed compression pressure (Pc). The control system 40 comprises: air tank 42 (for storing pressurized air); control valve 44 (for directing compressed air from the airtank 42 into the vest 10 and for releasing compressed air from the vest); control valve 44 (consisting of two independent valves 44*a* and 44*b*); vest pressure transducers 46 (for monitoring pressure in the vest); computer 48; motor 50; main air 52 (for pump air into tank 42); pilot air pump 54 (for generating compressed air to operate control valve 44); power supply 56; batteries 58; pilot pressure manifold 60 (distributes air to pneumatic valves 44). In operation, valve 44*a* will be open allowing air from tank 42 to flow through connecting tube 38 to inflate vest 10. When pressure traducer 46 detects pressure approaching compression pressure (Pc) the valve 44*a* is closed. At the appropriate time interval, valve 44*b* is open allowing compressed air in the vest 10 to escape. When sensor 46 detects the pressure in the vest approaching the bias pressure (Pb), computer 48 closes valve 44*b* (on the fifth cycle, the valve 44*b* remains open until the start of the next inflation cycle, allowing vest pressure to approach ambient pressure (Pa)). Computer 48 utilizes an algorithm to operate valves 44*a* and 44*b* in advance of the pressure reaching the preset levels to anticipate the time delay between valve actuation and actual closure.

Figure 6A:
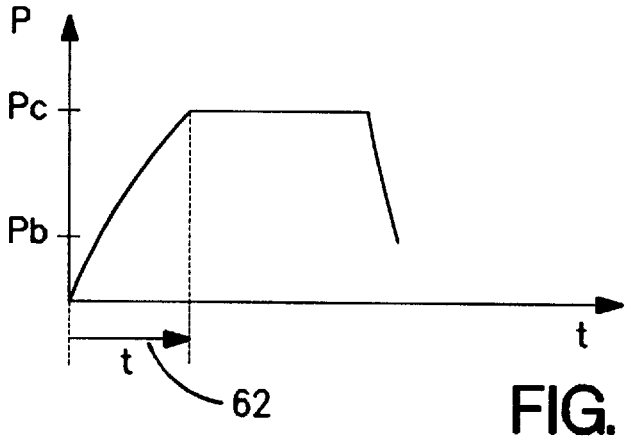
FIGS. 6*a*–6*b* show the pressure curve in the vest when the vest is either tightly applied (FIG. 6*a*) or loosely applied (FIG. 6*b*)
Figure 6B:
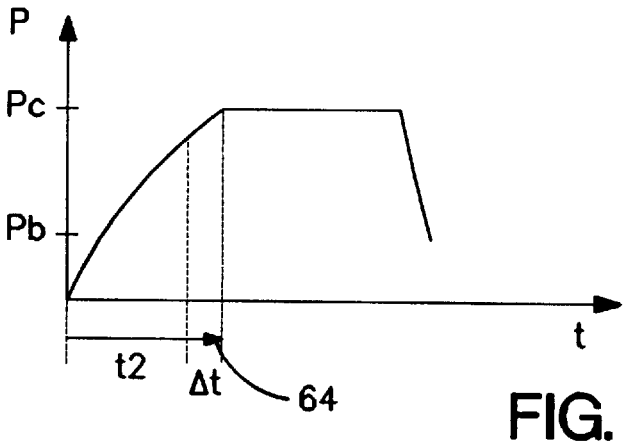

As mentioned earlier, the vest 10 is designed to expand radially. With this design feature it does not matter whether the vest is applied tightly or loosely. As shown in FIGS. 6*a* and 6*b*, the vest will expand to conform with the chest and is further pressurized to apply pressure until the compression pressure (Pc) is reached. In FIG. 6*a* the vest is tightly applied around the patient's chest and in FIG. 6*b* the vest is loosely applied. In both situations the vest will expand radially the appropriate distance to contact the chest and will then continue to apply pressure until the desired compression pressure (Pc) is achieved. However, when the vest is loosely applied, the amount of air that needs to flow into the loose vest (FIG. 6*b*) is greater and as a result the time to reach the compression pressure (Pc) will be greater. (Note the difference between t1 (62) in FIG. 6*a* and t2 (64)in FIG. 6*b*.). Therefore, the need for precise application of the vest to a certain tightness around the patient's chest is avoided. This feature is very important because in the hectic situation of responding to a patient's need, precise application of the vest should not be an additional concern to the physician team.

In another embodiment of the vest shown in FIGS. 7*a*, 7*b*, 8*a*, and 8*b*, the control valves 44 are placed either in the remote (vest end) end of the pneumatic hose 38 or directly on the vest. Such placement of the inflation/deflation control valves will reduce the amount of air consumed during the inflation and deflation cycle since the hose will no longer be inflated for each cycle. This feature reduces the amount of energy consumed during each cycle and will result in the use of a smaller motor, smaller storage tank and smaller batteries. This feature would be of particular importance for a portable CPR vest design.

Figure 7B:
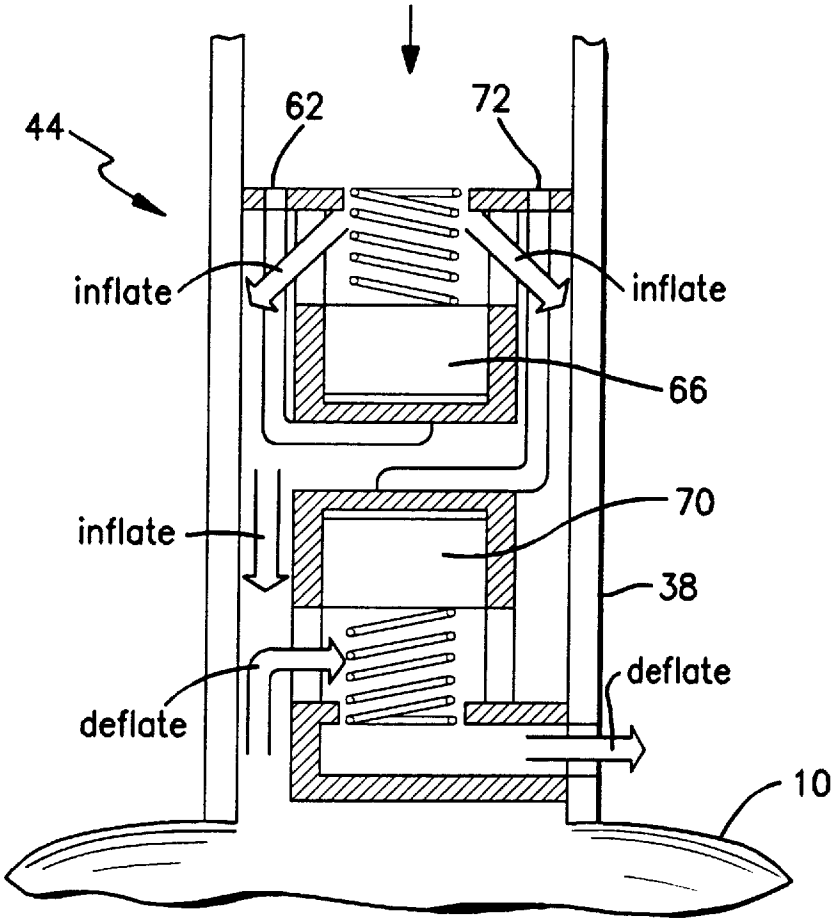
FIGS. 7*a*–7*b* show an inflation and deflation valve configuration incorporated into the pneumatic hose, to reduce energy consumption.
Figure 7A:
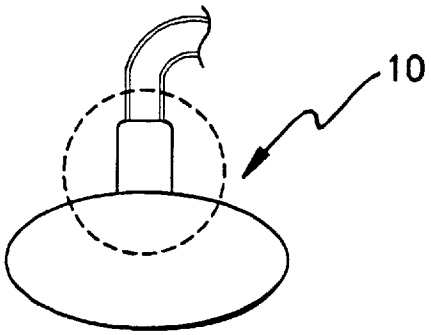
Figure 9:
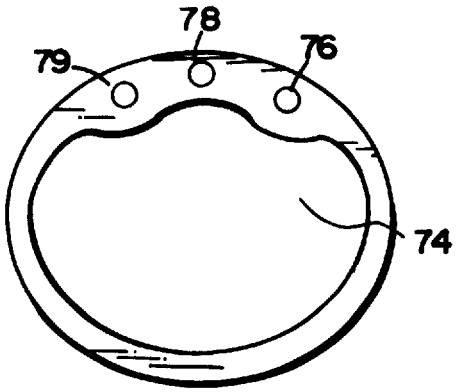
FIG. 9 is a cut-away view of a multilumen pneumatic tube used with the CPR vest.

In FIG. 7*b*, the control valves 44 are positioned in the vest end of pneumatic hose 38. A first inflation poppet valve 66 is controlled by pilot air 68 to allow pressurized air to enter the vest 10. A second deflation poppet valve 70 is controlled by pilot air 72 to allow pressure to escape from the vest 10. The inflation and deflation valves 44 work in a manner similar to those described earlier (see, FIG. 5). The pneumatic hose 38 used in this embodiment requires at least a three lumen design. As shown in FIG. 9, a first lumen 74 contains pressurized air for inflating the vest, a second lumen contains pressurized pilot air 68 for controlling the inflation poppet valve 66, and a third lumen contains pressurized pilot air 73 for controlling the deflation poppet valve 70. In an alternative design, four (4) lumens are used, one lumen for vest air supply, two lumens for valve pilot air and an additional lumen (79) used to detect vest pressure for the control computer.

Figure 8C:
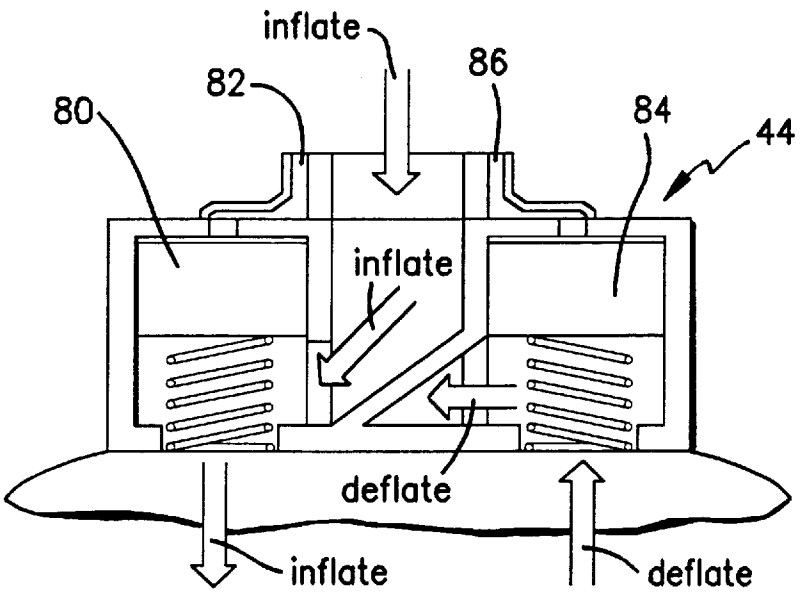
FIGS. 8*a*–8*c* show an inflation and deflation valve configuration incorporated into the vest, to reduce energy consumption.
Figure 8A:
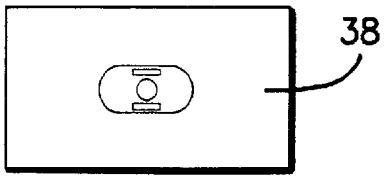
Figure 8B:
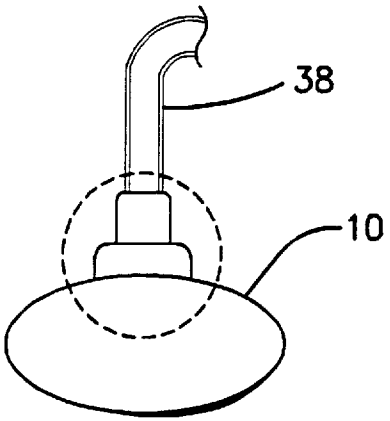

Similarly, as shown in FIGS. 8*a, b*, and *c*, the inflation and deflation valves 44 can be positioned on, and be part of, the disposable vest 10. As described previously, the pneumatic hose 38 contains at least three lumens to supply the inflation control pilot air, the deflation control pilot air and the pressurized inflation air (see, FIG. 8*a*). As shown in FIG. 8*c*, this embodiment also contains an inflation poppet valve 80 controlled by pilot air 82 and a deflation poppet 84 controlled by pilot air 86. Obviously, different valve designs are envisioned and valves that could be electronically activated are also within the contemplation of the inventors. The key is that the valves are positioned directly on the vest or on the vest end of the pneumatic hose. It is further envisioned that by placing the valves on the vest (or vest end of the pneumatic hose) that a sufficient reduction in power is achieved making a portable CPR vest system practical. This portable system would utilize a small pack of DC batteries to power the compression motors or be powered by a high pressure tank that is pre-charged with air at high pressures (around 4000psi).

Figure 10A:
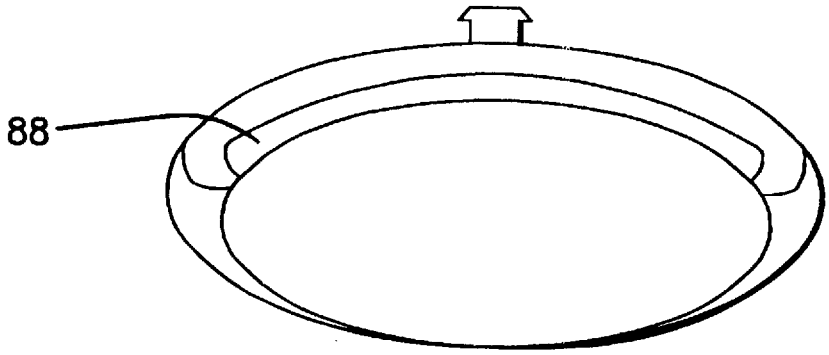
FIGS. 10*a*–10*c* show various configurations of vest design to eliminate the "dead space".
Figure 10B:
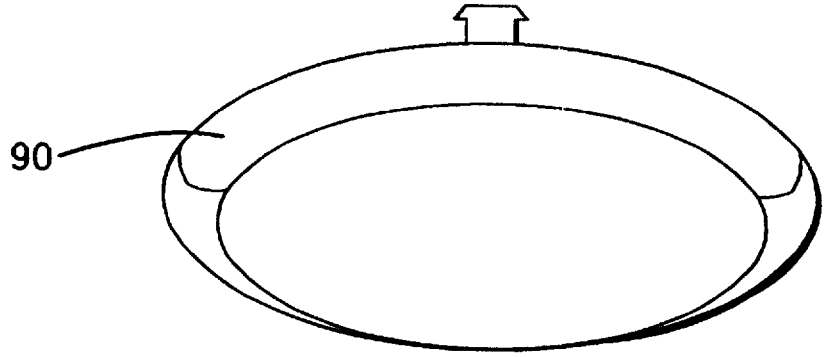
Figure 10C:
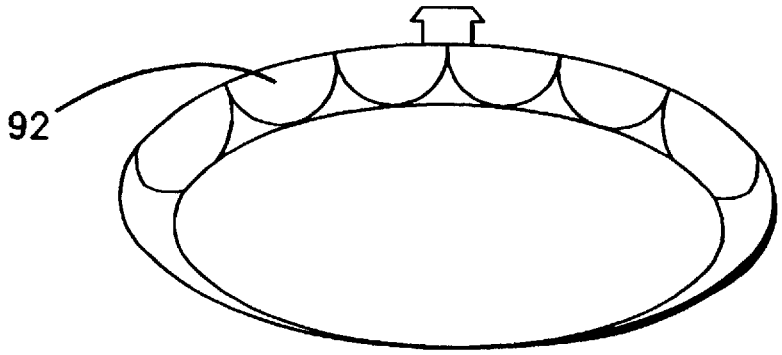

FIGS. 10*a*, 10*b*, and 10*c* show various embodiments of vest design that further reduce energy consumption by reducing the "dead space" in the vest. Thirty percent (30%) to forty percent (40%) of the energy used to operate the CPR vest is consumed by moving compressed air into "dead space" found in the vest's bladder and tubing. "Dead space" is defined as that volume of the bladder and tubing not contributing to chest compression. (The "dead space" in the tubing can be eliminated as described above, by placing the control valves directly on the vest or the vest end of the pneumatic hose.) Several solutions for reducing the "dead space" in the vest itself are shown in FIGS. 10*a*, 10*b*, and 10*c*. In FIG. 10*a*, a secondary bladder 88 is inflated by an air source to reduce the "dead space". This secondary bladder may be positioned either in front or behind the main bladder. It may also be partitioned as more fully described relative to FIG. 10*c*. In FIG. 10*b*, foam or other substances 90 are placed in the bladder to reduce the "dead space". In an alternative embodiment, the foam or other expandable substance would be injected into a secondary bladder to remove dead space in the primary bladder. In FIG. 10*c*, a partitioned, or honeycombed design 92 is used to reduce the "dead space". Reducing the "dead space" reduces the amount of compressed air needed to inflate the vest and to achieve the desired compression pressure (Pc). With less compressed air movement being required, less energy is needed to operate the CPR system.

Obviously, many modifications and variations of the present invention are possible in light of the above teachings. It is therefore to be understood that within the scope of the appended claims, the invention may be practiced otherwise than as specifically described.

What is claimed and desired to be secured by letters patent of the united states is:

1. An inflatable vest fitting circumferentially around a person's chest comprising:

a belt adapted to be secured circumferentially around the chest, formed of an inextensible material, and having a length sufficient to at least extend circumferentially around the chest;

a bladder to fit in juxtaposition to at least a front portion of the chest and having a width to substantially cover a height of the chest, said bladder defined by an inner surface of the belt, a chest panel adjacent the inner surface and formed of an inextensible material, and at least one side panel formed of an inextensible material and having a first side edge attached to circumferential edges of the chest panel and a second side edge, opposite to the first, attached to the inner surface of the belt;

wherein the chest panel has an external surface adapted to be in substantial contact with the chest of the patient:

wherein the side panel lies substantially flat against the belt when the bladder is deflated, and extends inward towards the chest when the bladder is inflated.

2. The vest of claim 1, wherein the second side edge of at least one side panel is attached to the inner surface of the belt substantially inward of side edges of the belt.

3. The vest of claim 1, wherein said belt forms a longitudinal overlap when circumferentially wrapped around the chest to secure the bladder to the chest and has a first longitudinal end having at least one Velcro strip attached to an outer surface of the belt and at least one Velcro strip on the inner surface extending from the bladder towards the second longitudinal end of the belt, and the Velcro strip on the outer surface attaches to the Velcro strip on the inner surface.

4. The vest of claim 3, wherein the first Velcro strip further comprises a pair of Velcro strips, each adjacent and parallel to respective side edges of the belt, and the second Velcro strip further comprises a pair of Velcro strips, each adjacent and parallel to the respective side edges of the belt.

5. The vest of claim 1, wherein said second longitudinal end of the belt further comprises a handle for for assisting to pull the vest under the patient without lifting the patient.

6. The vest of claim 1 wherein said bladder is formed of first and second sheets, where the first sheet is the chest panel, and the second sheet includes the at least one side panel, and the first and second sheets each have circumferential edges sealed together.

* * * * *